US008322820B2

(12) United States Patent
Hizawa

(10) Patent No.: US 8,322,820 B2
(45) Date of Patent: Dec. 4, 2012

(54) LIQUID EJECTING APPARATUS

(75) Inventor: Shunichi Hizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 13/026,485

(22) Filed: Feb. 14, 2011

(65) Prior Publication Data

US 2011/0204091 A1 Aug. 25, 2011

(30) Foreign Application Priority Data

Feb. 19, 2010 (JP) ..... 2010-034395

(51) Int. Cl.
*B41J 2/165* (2006.01)

(52) U.S. Cl. ..... 347/36; 347/89; 347/90

(58) Field of Classification Search ..... 347/6, 17, 347/34–36, 40, 42, 45, 47, 49, 65–72, 84–86, 347/89–90, 102
See application file for complete search history.

(56) References Cited

U.S. PATENT DOCUMENTS 5,686,943 A * 11/1997 Kneezel et al. ..... 347/17

FOREIGN PATENT DOCUMENTS

JP 10-291328 11/1998

* cited by examiner

*Primary Examiner* — Thinh Nguyen

(57) ABSTRACT

A waste liquid absorption material is laid within a waste liquid receptacle, and a portion of the waste liquid absorption material into which liquid flows is heated, causing the temperature of that portion to rise. This makes it possible to instigate a temperature difference between one side and the other side of capillary tubes within the waste liquid absorption material through which the liquid permeates, which makes it easy for the liquid to move from the high-temperature side to the low-temperature side of the waste liquid absorption material due to the thermocapillary phenomenon. This in turn makes it possible to increase the speed at which the liquid is absorbed by the waste liquid absorption material.

6 Claims, 4 Drawing Sheets

LIQUID EJECTING APPARATUS

BACKGROUND

1. Technical Field

The present invention relates to techniques for ejecting a liquid from an ejection head toward an ejection target.

2. Related Art

A so-called ink jet printer, which is an example of a liquid ejecting apparatus, is capable of printing high-quality images by ejecting precise amounts of ink onto precise locations of an ejection target such as paper from fine ejection nozzles provided in an ejection head. If various types of liquids aside from ink (for example, a liquid in which the particles of a functional material are dispersed) are ejected onto a substrate, it is also possible to manufacture electrodes, sensors, biochips, and so on using this technique.

With this technique, the liquid, such as ink, that is supplied to the ejection head will thicken as time passes due to the moisture therein evaporating or the components thereof vaporizing from the ejection nozzles. Such thickening can make it difficult to eject precise amounts of the liquid. Accordingly, in the case where the liquid has thickened, an operation in which the thickened liquid within the ejection head is sucked out through the ejection nozzles and discharged (a so-called cleaning operation) is carried out by bringing a cap into contact with the ejection head, forming an airtight space around the ejection nozzles with the cap, and producing negative pressure within the cap using a suction pump.

The liquid sucked out from the ejection nozzles through the cleaning operation is fed to a waste liquid receptacle via a waste liquid channel and is accumulated in the waste liquid receptacle. Providing a waste liquid absorption material configured of a nonwoven fabric or the like that absorbs liquid within this waste liquid receptacle has been proposed (for example, JP-A-10-291328), and it is possible, by allowing the waste liquid absorption material to absorb liquid that has flowed into the waste liquid receptacle, to prevent liquid from leaking out from the waste liquid receptacle.

However, a waste liquid receptacle in which a waste liquid absorption material is laid has a problem in that the waste liquid absorption material cannot completely absorb the liquid if a large amount of liquid has flowed into the waste liquid receptacle in a short amount of time. For example, it is desirable, when one wishes to reduce the amount of time required to carry out the aforementioned cleaning, to increase the suction power of the suction pump; however, doing so causes a large amount of liquid discharged due to the cleaning to flow into the waste liquid receptacle in a short amount of time. Even if the waste liquid absorption material is designed with a volume that is large enough to absorb (accumulate) the amount of liquid discharged through the cleaning, the absorption of the waste liquid absorption material cannot keep pace with the inflow of liquid when such a large amount of liquid flows into the waste liquid receptacle in a short amount of time; this leads to a risk of liquid leaking from the waste liquid receptacle.

SUMMARY

An advantage of some aspects of the invention is to provide a technique that enables an increase in the speed at which a waste liquid absorption material laid within a waste liquid receptacle absorbs liquid.

A liquid ejecting apparatus according to an aspect of the invention includes: an ejection head that ejects a liquid onto an ejection target; a waste liquid receptacle into which flows liquid that has been discharged without being ejected from the ejection head toward the ejection target; a waste liquid absorption material, laid in the waste liquid receptacle, that absorbs the liquid that has flowed into the waste liquid receptacle; and a heating unit that causes the temperature of a portion of the waste liquid absorption material into which the liquid flows to rise beyond the temperature of a portion of the waste liquid absorption material that is distanced from the portion of the waste liquid absorption material into which the liquid flows.

In the liquid ejecting apparatus according to this aspect of the invention, a waste liquid receptacle, into which liquid that could not be ejected from the ejection head toward the ejection target is discharged, is provided. A waste liquid absorption material is laid in this waste liquid receptacle, and waste liquid processing is carried out by causing the waste liquid absorption material to absorb liquid that has flowed into the waste liquid receptacle. In the liquid ejecting apparatus according to this aspect of the invention, the temperature of a portion of the waste liquid absorption material into which the liquid flows is caused to rise beyond the temperature of a portion of the waste liquid absorption material that is distanced from the portion of the waste liquid absorption material into which the liquid flows.

According to this aspect of the invention, the absorption of the liquid by the waste liquid absorption material can be accelerated by exploiting what is known as the thermocapillary phenomenon. The thermocapillary phenomenon is a phenomenon in which, when there is a temperature difference between the two sides of a capillary tube, a difference in surface tension between the two sides of the capillary tube arises, and a liquid within the capillary tube moves from the high-temperature side to the low-temperature side of the capillary tube. The waste liquid absorption material can be considered a conglomerate of countless capillary tubes through which the liquid passes, and thus if the temperature of the portion of the waste liquid absorption material into which the liquid flows is increased, a temperature difference can be caused to arise between the one end and the other end of the capillary tubes within the waste liquid absorption material through which the liquid permeates. As a result, it is easy for the liquid to move from the high-temperature side to the low-temperature side of the waste liquid absorption material due to the thermocapillary phenomenon; this in turn makes it possible to increase the speed at which the liquid is absorbed by the waste liquid absorption material. Accordingly, the liquid can be quickly absorbed by the waste liquid absorption material even if a large amount of liquid is discharged into the waste liquid receptacle in a short amount of time, which makes it possible to prevent the liquid from leaking out of the waste liquid receptacle.

Because the temperature of the portion of the waste liquid absorption material into which the liquid flows is raised, liquid can be prevented from leaking out of the waste liquid receptacle from the following standpoint as well. That is, if the temperature of the portion into which liquid flows is increased, the evaporation of moisture from that liquid, the vaporization of components in that liquid, and so on is accelerated, which makes it possible to reduce the total amount of liquid necessary for the waste liquid absorption material to absorb; as a result, the risk of liquid leaking out of the waste liquid receptacle is lowered further.

According to another aspect of the invention, the liquid ejecting apparatus may be configured as follows. First, the liquid is sucked from the ejection head using a suction pump driven by a driving motor, and that liquid is then discharged to the waste liquid receptacle. The temperature of the portion of the waste liquid absorption material into which the liquid flows is increased by providing a member that conducts heat produced by the driving of the driving motor to the waste liquid absorption material.

If generated heat from the driving motor of the suction pump that is driven when sucking liquid from the ejection head is used, it is not necessary to provide a separate dedicated heating source such as a heater in order to raise the temperature of part of the waste liquid absorption material, which makes it possible to increase the speed at which the waste liquid absorption material absorbs liquid with ease.

According to another aspect of the invention, the liquid ejecting apparatus may include a driving continuation unit that causes the driving of the driving motor to continue without sucking the liquid from the ejection head before an operation for sucking the liquid from the ejection head. The temperature of the waste liquid absorption material cannot be raised simply by driving the driving motor for the amount of time necessary to suck liquid from the ejection head. However, the temperature of the waste liquid absorption material can be raised by driving the driving motor without sucking the liquid from the ejection head.

Furthermore, according to another aspect of the invention, the driving continuation unit may cause the driving of the driving motor to continue until the temperature of the portion into which the liquid flows rises beyond the temperature of the portion that is distanced from the portion into which the liquid flows. The temperature of the waste liquid absorption material can be raised with certainty by driving the driving motor until the temperature of the waste liquid absorption material has risen.

According to another aspect of the invention, the liquid ejecting apparatus may cause the driving of the driving motor to continue without sucking the liquid from the ejection head after an operation for sucking the liquid from the ejection head has ended. Because it is not necessary to produce negative pressure using the suction pump after the operation for sucking liquid from the ejection head has ended, the driving of the driving motor may be continued without the suction pump performing suction.

According to this configuration, the portion of the waste liquid absorption material into which the liquid flows is kept at a high temperature even after the suction of liquid from the ejection head has ended and the liquid has stopped flowing into the waste liquid receptacle. Accordingly, the liquid is prompted to move (permeate) from the high-temperature side to the low-temperature side of the waste liquid absorption material due to the thermocapillary phenomenon; therefore, the liquid can be widely dispersed and held within the waste liquid absorption material. Through this, the liquid does not accumulate in the portion of the waste liquid absorption material into which the liquid flows, thus making it possible for the liquid to be absorbed by the waste liquid absorption material quickly the next time the liquid is discharged into the waste liquid receptacle as well.

Furthermore, according to another aspect of the invention, in the liquid ejecting apparatus, the heating unit may be a concave portion provided in the waste liquid receptacle and the driving motor disposed within the concave portion. The heat produced by the driving motor can be conducted to the waste liquid absorption material without a loss of heat by disposing the driving motor within the concave portion provided in the waste liquid receptacle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described according to the following order in order to clarify the content of the invention.

Apparatus Configuration

Configuration of Liquid Ejecting Apparatus

Configuration of Maintenance Mechanism

Cleaning Operation According to Embodiment

Apparatus Configuration

Configuration of Liquid Ejecting Apparatus

Figure 1:
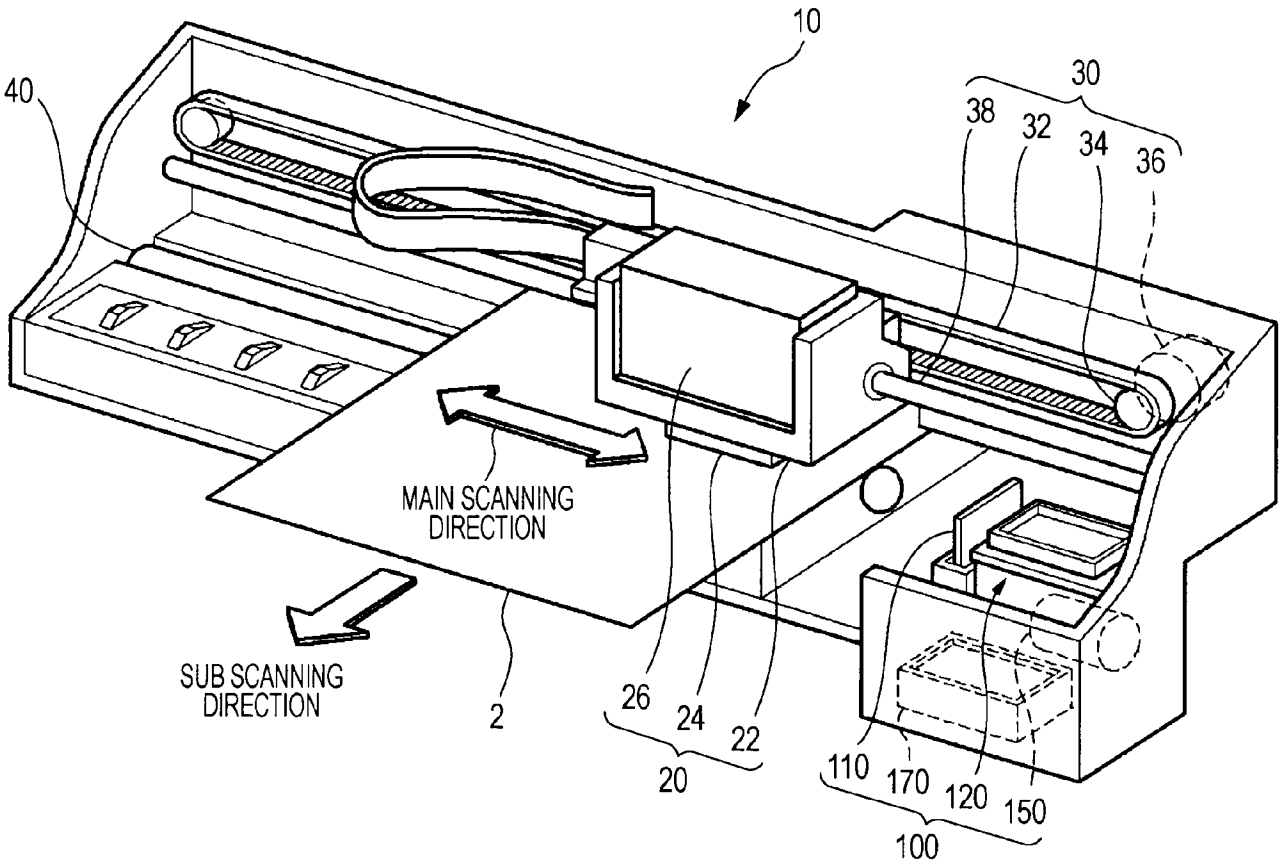
FIG. 1 is a descriptive diagram illustrating the general configuration of a liquid ejecting apparatus according to an embodiment of the invention, using an ink jet printer as an example.

FIG. 1 is a descriptive diagram illustrating the general configuration of a liquid ejecting apparatus according to this embodiment, using what is known as an ink jet printer as an example. As shown in FIG. 1, an ink jet printer 10 is configured of: a carriage 20 that forms ink dots upon a print medium 2 such as print paper or the like while moving back and forth in the main scanning direction; a driving mechanism 30 that moves the carriage 20 back and forth; a platen roller 40 for feeding the print medium 2; a maintenance mechanism 100 that carries out maintenance for ensuring normal printing; and so on. The carriage 20 is provided with an ink cartridge 26 that holds ink, a carriage case 22 in which the ink cartridge 26 is installed, an ejection head 24 installed in the base surface side (that is, the side facing the print medium 2) of the carriage case 22, and so on. Multiple ejection nozzles that eject ink are formed in the ejection head 24, and images are printed by conducting the ink within the ink cartridge 26 to the ejection head 24 and ejecting a precise amount of ink from the ejection nozzles onto the print medium 2.

The driving mechanism 30 that moves the carriage 20 back and forth is configured of: a guide rail 38 that extends in the main scanning direction; a timing belt 32, on the inner side of which multiple teeth are formed; a driving pulley 34 that interlocks with the teeth of the timing belt 32; a step motor 36 for driving the driving pulley 34; and so on. Part of the timing belt 32 is anchored to the carriage case 22, and the carriage case 22 can be moved along the guide rail 38 by driving the timing belt 32. Furthermore, the timing belt 32 and the driving pulley 34 interlock with each other through the teeth, and thus when the step motor 36 drives the driving pulley 34, the carriage case 22 can be moved with precision based on the driving amount.

The platen roller 40 that feeds the print medium 2 is driven by a driving motor, a gear mechanism, and so on (not shown), and is capable of transporting the print medium 2 by predetermined increments in the sub scanning direction.

Meanwhile, the maintenance mechanism 100, provided in a region called the "home position" that is outside of the print region, is configured of: a wiper blade 110 that wipes the surface of the base surface side of the ejection head 24 in which the ejection nozzles are formed (that is, the nozzle surface); a cap unit 120 that is pushed against the nozzle surface of the ejection head 24 and that forms an airtight space around the ejection nozzles; a suction pump 150 provided in a location below the cap unit 120; a waste liquid receptacle 170 that is in turn provided below the suction pump 150; and so on. Next, the configuration of the maintenance mechanism 100 will be described in detail.

Configuration of Maintenance Mechanism

Figure 2:
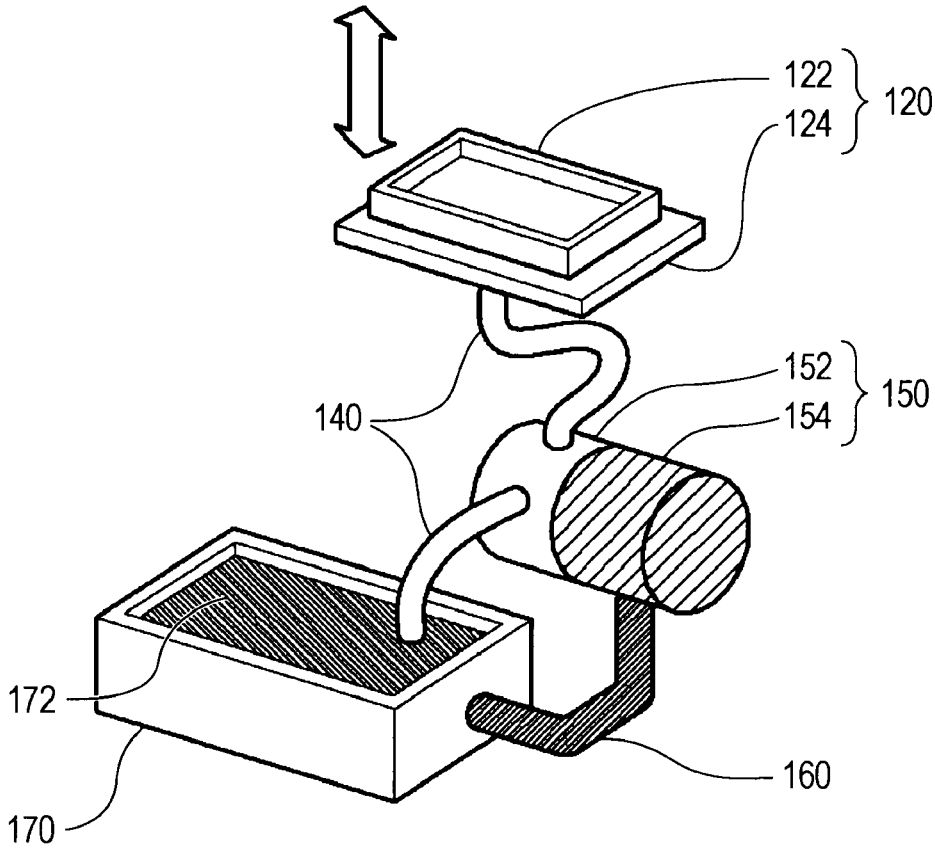
FIG. 2 is a descriptive diagram illustrating the configuration of a maintenance mechanism installed in an ink jet printer according to an embodiment of the invention.

FIG. 2 is a descriptive diagram illustrating the configuration of the maintenance mechanism 100 installed in the ink jet printer 10 according to this embodiment. As mentioned above, the maintenance mechanism 100 is configured of the wiper blade 110, the cap unit 120, the suction pump 150, the waste liquid receptacle 170, and so on; however, here, the cap unit 120, the suction pump 150, and the waste liquid receptacle 170 will be described in detail, whereas the wiper blade 110 has been omitted from FIG. 2.

As illustrated in FIG. 2, the cap unit 120 is configured by providing a cap 122, formed in a concave shape using an elastic material such as rubber or the like, upon the upper surface side (that is, the side that faces the ejection head 24) of a cap plate 124 having an approximately rectangular shape. This cap unit 120 can be moved up and down by an actuator (not shown). When printing is not being carried out, an airtight space can be formed around the ejection nozzles by raising the cap unit 120 after the carriage 20 has been moved to the home position and pushing the cap 122 against the nozzle surface of the ejection head 24. Note that in this specification, forming an airtight space around the ejection nozzles using the cap 122 is referred to as "capping". Carrying out capping in this manner makes it possible to prevent the moisture within the ink from evaporating or the components within the ink from vaporizing through the ejection nozzles.

A suction opening (not shown) is provided in the base surface of the cap 122 that is formed in a concave shape, and the suction opening is connected to the suction pump 150 by a tube 140 that is formed of an elastic material.

The suction pump 150 according to this embodiment is what is known as a tube pump, and is configured of a housing 152 that houses part of the tube 140 and a motor 154 that drives the tube pump. A circular rotating plate (not shown), to which is attached a roller that chokes the tube 140 by pressing thereupon, is provided within the housing 152, and this circular rotating plate is connected to the motor 154. When the circular rotating plate rotates due to the driving of the motor 154 and the roller moves as a result, the choked location of the tube 140 is moved, and thus the fluid within the tube 140 (ink or air) is pushed downstream. After the passage of the roller, the fluid on the upstream side is sucked in due to the restitution force of the tube 140, which generates negative pressure.

As mentioned earlier, when the ink jet printer 10 is not printing, capping is carried out by pressing the cap 122 against the nozzle surface of the ejection head 24; however, the moisture, volatile components, and so on in the ink decrease little by little in the ejection head 24, causing the ink to thicken, and thus ink cannot be ejected properly if a long period of time passes without printing being carried out. In such a case, an operation for sucking thickened ink within the ejection head 24 through the ejection nozzles (called "cleaning") is carried out by operating the suction pump 150 with the cap 122 pressed against the nozzle surface of the ejection head 24 and producing negative pressure within the cap 122 (that is, the airtight space around the ejection nozzles. The ink that has been sucked through the ejection nozzles as a result of the cleaning flows into the waste liquid receptacle 170 provided below the suction pump 150. Note that details of the cleaning operation according to this embodiment will be given later.

In the ink jet printer 10 according to this embodiment, the waste liquid receptacle 170 is formed of a plastic material in a rectangular parallelepiped shape, and the top thereof is open. A waste liquid absorption material 172 formed of a nonwoven fabric or the like is laid within the waste liquid receptacle 170, and ink that flows into the waste liquid receptacle 170 is absorbed and held by the waste liquid absorption material 172. The ink that has been absorbed by the waste liquid absorption material 172 within the waste liquid receptacle 170 in this manner gradually decreases as the moisture therein evaporates or the components thereof vaporize.

Meanwhile, as shown in FIG. 2, the waste liquid receptacle 170 according to this embodiment is connected to the motor 154 of the suction pump 150 by a thermal conductive pipe 160 formed of a copper pipe; although details will be given later, the heat generated by the driving of the motor 154 is conducted to the waste liquid absorption material 172 laid within the waste liquid receptacle 170 through the thermal conductive pipe 160. The material of the thermal conductive pipe 160 is not limited to copper, and any material may be used as long as that material effectively conducts heat.

Furthermore, when the aforementioned cleaning is carried out, the ink that has been sucked out sticks to the periphery of the ejection nozzles, which, if left alone, leads to problems such as clogs in the ejection nozzles. Accordingly, an operation for wiping the ink that sticks to the periphery of the ejection nozzles using the wiper blade 110 (see FIG. 1) is carried out after the cleaning process has ended.

The ink jet printer 10 according to this embodiment is kept capable of normal printing by carrying out various types of maintenance using the maintenance mechanism 100 described above. Hereinafter, a cleaning operation carried out by the ink jet printer 10 according to this embodiment will be described in detail.

Cleaning Operation According to Embodiment

Figure 3:
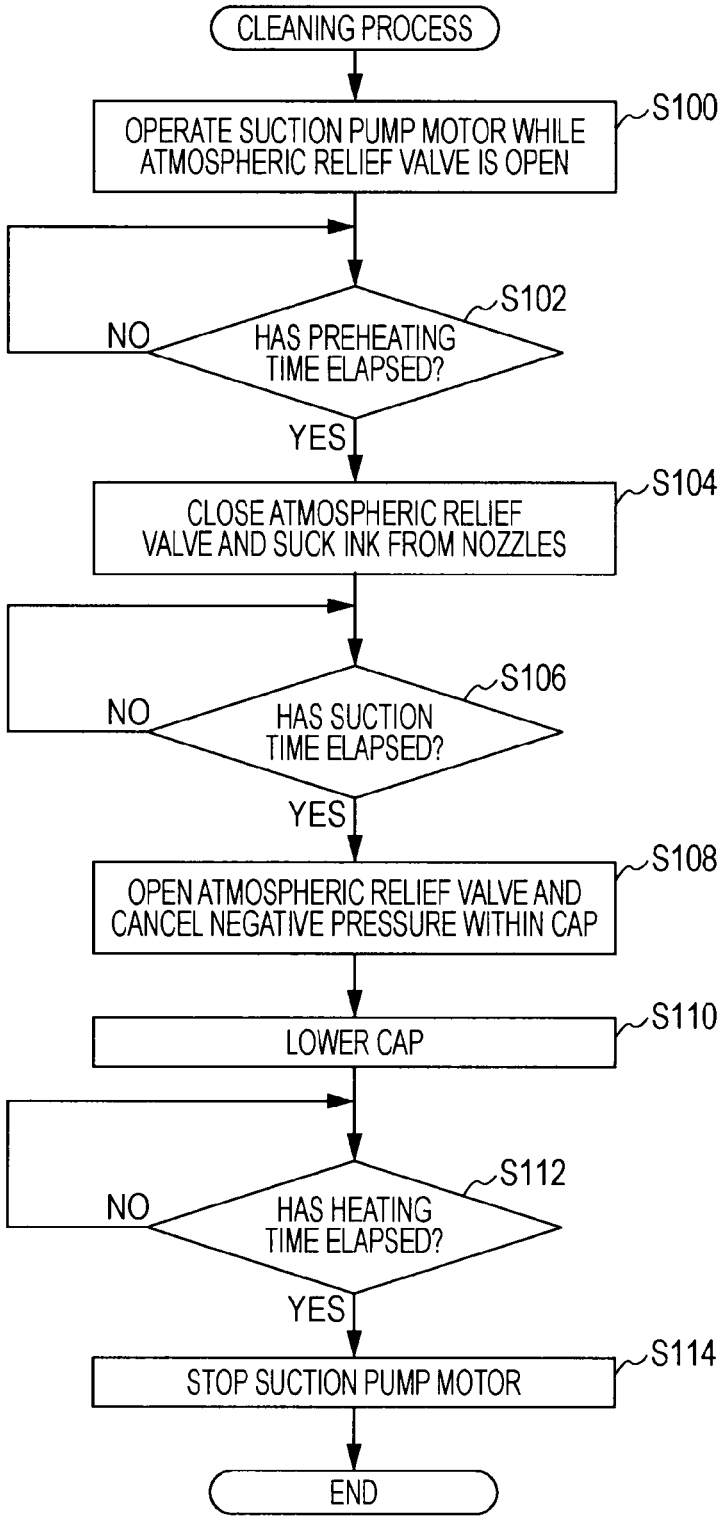
FIG. 3 is a flowchart illustrating the flow of a process executed when an ink jet printer carries out cleaning (a cleaning process) according to an embodiment of the invention.

FIG. 3 is a flowchart illustrating the flow of a process executed when the ink jet printer 10 according to this embodiment carries out cleaning (a cleaning process). This process is commenced in a capped state, in which the carriage 20 has been moved to the home position and the cap 122 has been pressed against the nozzle surface of the ejection head 24.

When the cleaning process is commenced, first, the motor 154 of the suction pump 150 is operated in a state in which an atmospheric relief valve is open (step S100). The atmospheric relief valve, which is not shown, is connected to the cap 122 in this embodiment. When the atmospheric relief valve is open, atmospheric air can flow into the cap 122, and thus negative pressure is not produced within the cap 122 even if the motor 154 of the suction pump 150 is operated.

When the motor 154 of the suction pump 150 is operated, it is then determined whether or not the amount of time that has elapsed following the operation of the motor 154 has reached a predetermined preheating time (step S102). This preheating time is determined in advance using, as a reference, the time until the temperature of the motor 154 reaches a predetermined temperature due to the heat produced by the motor 154 during operation. In the case where the preheating time has not yet been reached (step S102: no), the apparatus stands by until the preheating time is reached. Note that as mentioned earlier, the motor 154 of the suction pump 150 is connected to the waste liquid receptacle 170 by the thermal conductive pipe 160, and thus the heat from the motor 154 is conducted to the waste liquid absorption material 172 within the waste liquid receptacle 170 through the thermal conductive pipe 160.

On the other hand, in the case where the preheating time has been reached following the operation of the motor 154 (step S102: yes), suction of the ink through the ejection nozzles is commenced by closing the atmospheric relief valve and producing negative pressure within the cap 122 (step S104). As mentioned earlier, the ink sucked through the ejection nozzles flows into the waste liquid receptacle 170. Note that the state of the ink that is sucked through the ejection nozzles of the ejection head 24 and that flows into the waste liquid receptacle 170 through the cleaning process will be described in detail later using a different diagram.

Next, it is determined whether or not a predetermined suction time has elapsed following the commencement of the suction of the ink through the ejection nozzles (step S106). In the case where the suction time has not yet elapsed (step S106: no), it is determined that the ink that has thickened within the ejection head 24 has not yet been completely sucked, and thus the apparatus stands by until the suction time has elapsed.

On the other hand, in the case where the suction time has elapsed (step S106: yes), the negative pressure within the cap 122 is eliminated by opening the atmospheric relief valve and allowing atmospheric air to flow into the cap 122, thus ending the suction of ink through the ejection nozzles (step S108). Note that the suction pump 150 continues to be driven even after the atmospheric relief valve is opened, and thus the ink that has been sucked through the ejection nozzles and has accumulated within the cap 122 is sucked into the tube 140 through the suction opening provided in the base of the cap 122, and is then discharged to the waste liquid receptacle 170.

Once the negative pressure within the cap 122 has been eliminated, the cap 122 is lowered while the motor 154 of the suction pump 150 continues to be driven (step S110). As mentioned earlier, an operation for wiping the ink from the periphery of the ejection nozzles is carried out after the cleaning process has ended. In the ink jet printer 10 according to this embodiment, the nozzle surface of the ejection head 24 is wiped by the wiper blade 110 (see FIG. 1) by causing the wiper blade 110 to rise as the cap 122 is lowered and moving the carriage 20 from the home position toward the wiper blade 110 (that is, toward the print region).

In the cleaning process illustrated in FIG. 3, it is determined whether or not a predetermined heating time has elapsed after the cap 122 has been lowered (step S112). In the ink jet printer 10 according to this embodiment, the motor 154 of the suction pump 150 is driven until the predetermined heating time has elapsed even after the cap 122 has been lowered, and thus the heat produced by the motor 154 is supplied to the waste liquid absorption material 172 within the waste liquid receptacle 170 through the thermal conductive pipe 160. In the case where the heating time has not yet elapsed (step S112: no), the apparatus stands by until the heating time has elapsed. However, in the case where the heating time has elapsed (step S112: yes), the motor 154 of the suction pump 150 is stopped (step S114), and the cleaning process illustrated in FIG. 3 ends.

In the ink jet printer 10 according to this embodiment, new ink is supplied to the ejection head 24 by executing the aforementioned cleaning process and sucking thickened ink within the ejection head 24 out through the ejection nozzles. Hereinafter, the state of the ink that is sucked through the ejection nozzles of the ejection head 24 and that flows into the waste liquid receptacle 170 as a result of the execution of the cleaning process will be described.

Figure 4A:
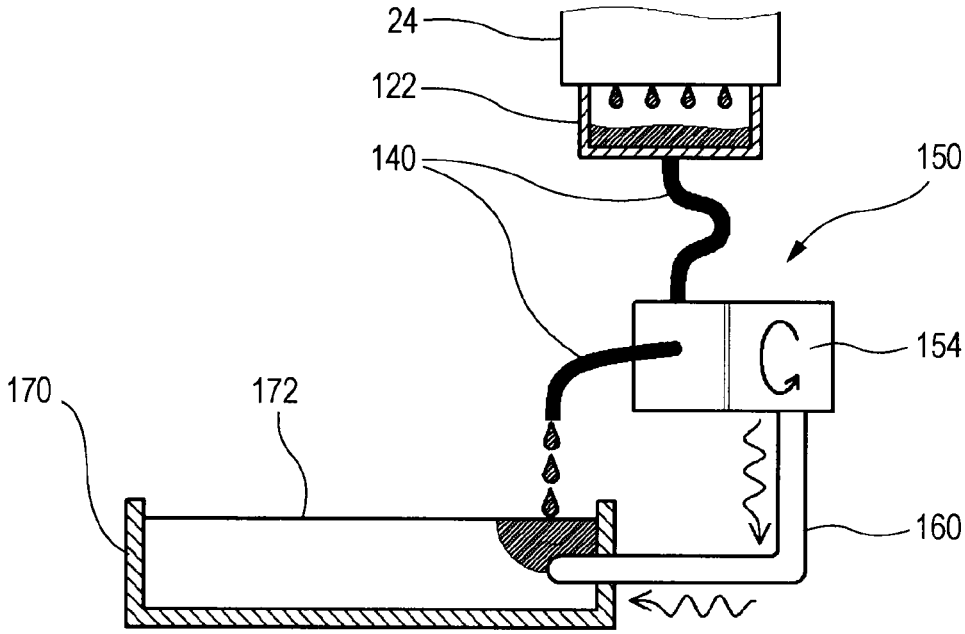
FIGS. 4A and 4B are descriptive diagrams illustrating the state of ink that is sucked through ejection nozzles of an ejection head and that flows into a waste liquid receptacle as a result of cleaning.
Figure 4B:
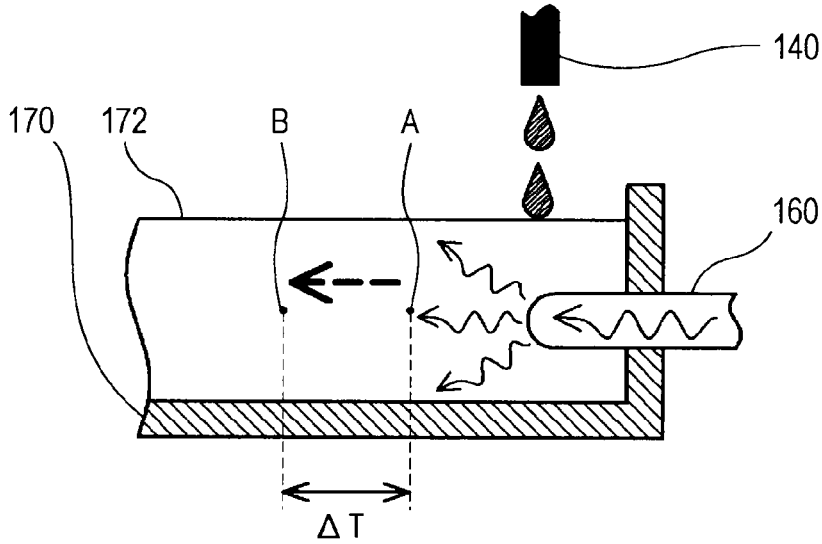

FIGS. 4A and 4B are descriptive diagrams illustrating the state of the ink that is sucked through the ejection nozzles of the ejection head 24 and that flows into the waste liquid receptacle 170 as a result of the cleaning. First, as illustrated in FIG. 4A, when an airtight space is formed within the cap 122 by closing the atmospheric relief valve, the ink within the ejection head 24 is sucked into the cap 122 through the ejection nozzles due to the negative pressure produced by the suction pump 150 that is connected to the cap 122. The ink that is sucked into the cap 122 in this manner is then sucked into the tube 140 through the suction opening provided in the base of the cap 122, and is discharged to the waste liquid receptacle 170 via the suction pump 150. Furthermore, the ink that is discharged into the waste liquid receptacle 170 is absorbed by the waste liquid absorption material 172 laid within the waste liquid receptacle 170.

Here, as mentioned earlier, the waste liquid receptacle 170 according to this embodiment is connected to the motor 154 of the suction pump 150 by the thermal conductive pipe 160 that is formed of a copper pipe, and thus the heat produced by the driving of the motor 154 is conducted to the waste liquid receptacle 170 through the thermal conductive pipe 160. The end of the thermal conductive pipe 160 on the side of the waste liquid receptacle 170 is inserted into one end of the waste liquid absorption material 172 laid within the waste liquid receptacle 170, and thus the one end of the waste liquid absorption material 172 (that is, the portion into which the thermal conductive pipe 160 is inserted) is heated by the heat of the motor 154 through the thermal conductive pipe 160. In the ink jet printer 10 according to this embodiment, the portion of the waste liquid absorption material 172 into which the ink flows is heated by the heat of the motor 154. Note that the wavy arrows in FIGS. 4A and 4B indicate the transmission of heat.

Next, as illustrated in FIG. 4B, the heat from the motor 154 is conducted from the end of the thermal conductive pipe 160 to the waste liquid absorption material 172, and thus the temperature of a point A in the waste liquid absorption material 172 is higher than the temperature of a point B, which is in a location that is farther from the thermal conductive pipe 160 than the point A, resulting in a temperature difference between the point A and the point B.

In the ink jet printer 10 according to this embodiment, it is possible to accelerate the absorption of ink by the waste liquid absorption material 172 by heating one end of the waste liquid absorption material 172, causing a temperature difference to arise within the waste liquid absorption material 172, and exploiting what is known as the thermocapillary phenomenon. This will be described in detail hereinafter.

First, the thermocapillary phenomenon is a phenomenon in which, when there is a temperature difference between the two sides of a capillary tube, a difference in surface tension between the two sides of the capillary tube arises due to that temperature difference, and a liquid within the capillary tube moves from the high-temperature side to the low-temperature side of the capillary tube. The waste liquid absorption material 172, which is capable of absorbing a liquid such as ink, can be considered a conglomerate of countless capillary tubes through which the liquid passes. For example, in the case where the waste liquid absorption material 172 is a nonwoven fabric, the capillary tubes formed among the fibers are continuously connected, and the ink permeates these capillary tubes. Accordingly, when the temperature in one part of the waste liquid absorption material 172 rises, a temperature difference arises between one end and the other end of the capillary tubes in the waste liquid absorption material 172; because the ink absorbed by the waste liquid absorption material 172 moves with ease from the high-temperature side to the low-temperature side (in FIG. 4B, the direction indicated by the dotted line arrow) due to the thermocapillary phenomenon, the speed at which ink is absorbed by the waste liquid absorption material 172 can be increased. As a result, even if a large amount of ink flows into the waste liquid receptacle 170 in a short amount of time due to cleaning, the ink is quickly absorbed by the waste liquid absorption material 172 within the waste liquid receptacle 170, and thus it is possible to prevent the ink from leaking out of the waste liquid receptacle 170.

Meanwhile, in the ink jet printer 10 according to this embodiment, generated heat produced by the motor 154 of the suction pump 150 that is driven in the execution of the cleaning is used in order to raise the temperature of a part of the waste liquid absorption material 172. Accordingly, it is not necessary to provide a new heat source, such as a heater, for heating part of the waste liquid absorption material 172, which makes it possible to realize an increase in the speed at which the ink is absorbed by the waste liquid absorption material 172 in a simple manner.

In addition, as described earlier, in the ink jet printer 10 according to this embodiment, a preheating time to drive the motor 154 of the suction pump 150 while the atmospheric relief valve of the cap 122 is open is provided. Accordingly, when the atmospheric relief valve is closed and the suction of ink through the ejection nozzles is commenced, part of the waste liquid absorption material 172 within the waste liquid receptacle 170 is already in a heated state due to the heat generated by the motor 154. Because a temperature difference has already been produced in the waste liquid absorption material 172 in this manner prior to the ink being sucked through the ejection nozzles, the ink can be absorbed by the waste liquid absorption material 172 more quickly at the point in time at which the ink sucked through the ejection nozzles begins to flow into the waste liquid receptacle 170.

Furthermore, in the ink jet printer 10 according to this embodiment, the driving of the motor 154 of the suction pump 150 is continued from the time when the suction of ink through the ejection nozzles ends and the cap 122 is lowered to the time when the predetermined heating time is reached. Accordingly, part of the waste liquid absorption material 172 within the waste liquid receptacle 170 is heated even after ink has stopped flowing into the waste liquid receptacle 170, and the ink is prompted to move (permeate) from the high-temperature side to the low-temperature side of the waste liquid absorption material 172 due to the thermocapillary phenomenon; therefore, the ink can be widely dispersed and held within the waste liquid absorption material 172. As a result, the ink does not accumulate in the portions of the waste liquid absorption material 172 into which the ink flows, thus making it possible for the ink to be absorbed by the waste liquid absorption material 172 more quickly the next time ink flows into the waste liquid receptacle 170.

In addition, in the ink jet printer 10 according to this embodiment, the portion of the waste liquid absorption material 172 into which the ink flows is heated by the excess heat from the motor 154. When part of the waste liquid absorption material 172 is heated, the temperature tends to drop (that is, approach room temperature) as the waste liquid absorption material 172 progresses away from the heated portion. If the ink is caused to flow into the location where this temperature slope is highest (that is, the heated portion), the ink can be caused to disperse (permeate) more widely into the waste liquid absorption material 172 from the high-temperature side to the low-temperature side using the thermocapillary phenomenon, as compared to a case where the ink is caused to flow into a location that is far away from the heated portion. This results in an increase in the effectiveness of the ink suction of the waste liquid absorption material 172. Furthermore, causing the ink to flow into the heated portion (that is, the portion at the highest temperature) of the waste liquid absorption material 172 also encourages the evaporation of moisture in the ink or the vaporization of the components in the ink, which in turn achieves an effect in that the amount of ink that is required of the waste liquid absorption material 172 to absorb is reduced. As a result, the risk of ink leaking out of the waste liquid receptacle 170 can be reduced.

Although an embodiment of a liquid ejecting apparatus according to the invention has been described above, the invention is not limited to the aforementioned embodiment, and the invention can be embodied in various other forms without departing from the essential spirit thereof.

For example, in the aforementioned embodiment, the temperature of part of the waste liquid absorption material 172 is caused to rise by conducting the heat produced by the motor 154 of the suction pump 150 using the thermal conductive pipe 160. However, the invention is not limited thereto, and part of the waste liquid absorption material 172 may be heated by providing a dedicated heater that serves as a heat source and using that heater. Furthermore, the waste liquid absorption material 172 may be heated by disposing the motor 154 of the suction pump 150 on a side of the waste liquid receptacle 170, disposing the motor 154 into a concave portion provided in a side of the waste liquid receptacle 170, or the like. Note that although the motor of a suction pump may have been disposed in the vicinity of a waste liquid receptacle in the past, the motor does not produce enough heat to heat a waste liquid absorption material within the waste liquid receptacle if the motor is driven only while ink is sucked, discharged, and so on.

Furthermore, in the aforementioned embodiment, the motor 154 is configured integrally with the suction pump 150, and negative pressure is produced by the suction pump 150 while the motor 154 is being driven. However, rather than the motor 154 being integrated with the suction pump 150, the configuration may be such that the driving of the motor 154 can be switched between a case in which the driving of the motor 154 is transmitted to the suction pump 150 and negative pressure is produced and a case in which the driving of the motor 154 is not transmitted to the suction pump 150 and negative pressure is not produced. In this case, the motor 154 can be driven without the suction pump 150 producing negative pressure, and thus in step S100 of FIG. 3, the motor 154 may be driven alone without the suction pump 150 producing negative pressure, and in step S104, the suction pump 150 can be caused to produce negative pressure through the driving of the motor 154. Furthermore, it is not necessary to cause the suction pump 150 to produce negative pressure after the suction of ink through the ejection nozzles has ended and the cap 122 has been lowered (step S110), and thus the driving of the motor 154 may be continued without causing ink to be sucked from the ejection head.

The entire disclosure of Japanese Patent Application No. 2010-34395, filed Feb. 19, 2010 is expressly incorporated by reference herein.

What is claimed is:

1. A liquid ejecting apparatus comprising:

an ejection head that ejects a liquid onto an ejection target;

a waste liquid receptacle into which flows liquid that has been discharged without being ejected from the ejection head toward the ejection target;

a waste liquid absorption material, laid in the waste liquid receptacle, that absorbs the liquid that has flowed into the waste liquid receptacle; and a heating unit that causes the temperature of a portion of the waste liquid absorption material into which the liquid flows to rise beyond the temperature of a portion of the waste liquid absorption material that is distanced from the portion of the waste liquid absorption material into which the liquid flows.

2. The liquid ejecting apparatus according to claim 1, further comprising:

a suction pump that sucks the liquid from the ejection head and discharges the sucked liquid into the waste liquid receptacle; and a driving motor that drives the suction pump, wherein the heating unit is a member that conducts heat produced by the driving of the driving motor to the portion of the waste liquid absorption material into which the liquid flows.

3. The liquid ejecting apparatus according to claim 2, further comprising:

a driving continuation unit that causes the driving of the driving motor to continue without sucking the liquid from the ejection head before an operation for sucking the liquid from the ejection head.

4. The liquid ejecting apparatus according to claim 2, wherein the driving continuation unit causes the driving of the driving motor to continue until the temperature of the portion into which the liquid flows rises beyond the temperature of the portion that is distanced from the portion into which the liquid flows.

5. The liquid ejecting apparatus according to claim 4, further comprising:

a driving continuation unit that causes the driving of the driving motor to continue without sucking the liquid from the ejection head after an operation for sucking the liquid from the ejection head has ended.

6. The liquid ejecting apparatus according to claim 1, wherein the heating unit is a concave portion provided in the waste liquid receptacle and the driving motor disposed within the concave portion.

* * * * *